United States Patent [19]

Diry

[11] 4,079,688

[45] Mar. 21, 1978

[54] DISPLACEMENT HULL

[76] Inventor: George L. Diry, 104 St. Joseph Ave., Long Beach, Calif. 90803

[21] Appl. No.: 713,719

[22] Filed: Aug. 12, 1976

[51] Int. Cl.[2] ..... B63B 1/04; B63B 1/12

[52] U.S. Cl. ..... 114/56; 114/61

[58] Field of Search ..... 114/26, 40, 41, 56, 114/61, 63, 271

[56] References Cited

U.S. PATENT DOCUMENTS

| | | | |
|---|---|---|---|
| 996,444 | 6/1911 | Yarrington | 114/61 |
| 2,899,925 | 8/1959 | Meek | 114/61 |
| 2,950,699 | 8/1960 | Ogden et al. | 114/61 |
| 3,566,819 | 3/1971 | Keddie | 114/61 |

*Primary Examiner*—Trygve M. Blix
*Assistant Examiner*—Stuart M. Goldstein
*Attorney, Agent, or Firm*—Robert Louis Finkel

[57] ABSTRACT

A low-drag hull for high-speed displacement type water-craft is constructed with a constant-section keel-less midbody having a length equal to or greater than one-third of the waterline length of the hull, and with a run of less than one-sixth of the hull length. The balance of the hull comprises a slender entry defined by a linear basal ramp extending at the centerline for at least one-half of the length of the entry. The ramp slope is chosen in the range between 10:1 and 18:1. The parallel midbody is constructed with a full cross-section, the section coefficient being always greater than .785, and the ramped entry conforms, within the limits established by the need to fair in the bow and transition sections, to the sectional character of the midbody. The hull form shows a low wetted surface coefficient and sharply reduced wave-making resistance in the range between Froude numbers of 0.60 and 1.20.

13 Claims, 8 Drawing Figures

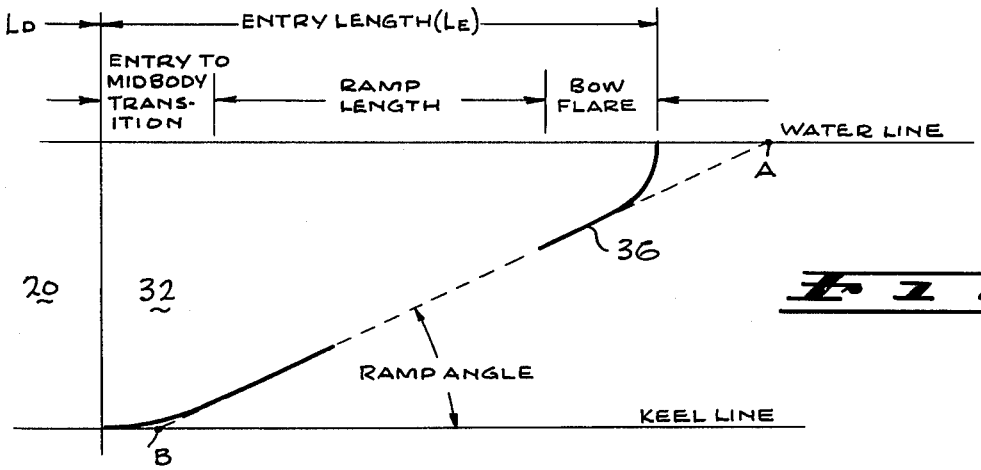
Fig. 4
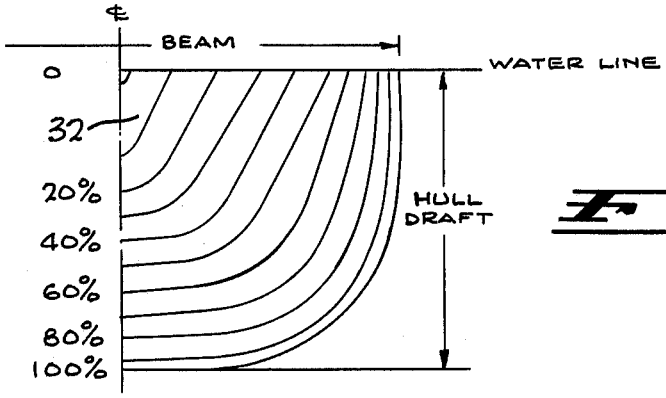
Fig. 5
Fig. 6
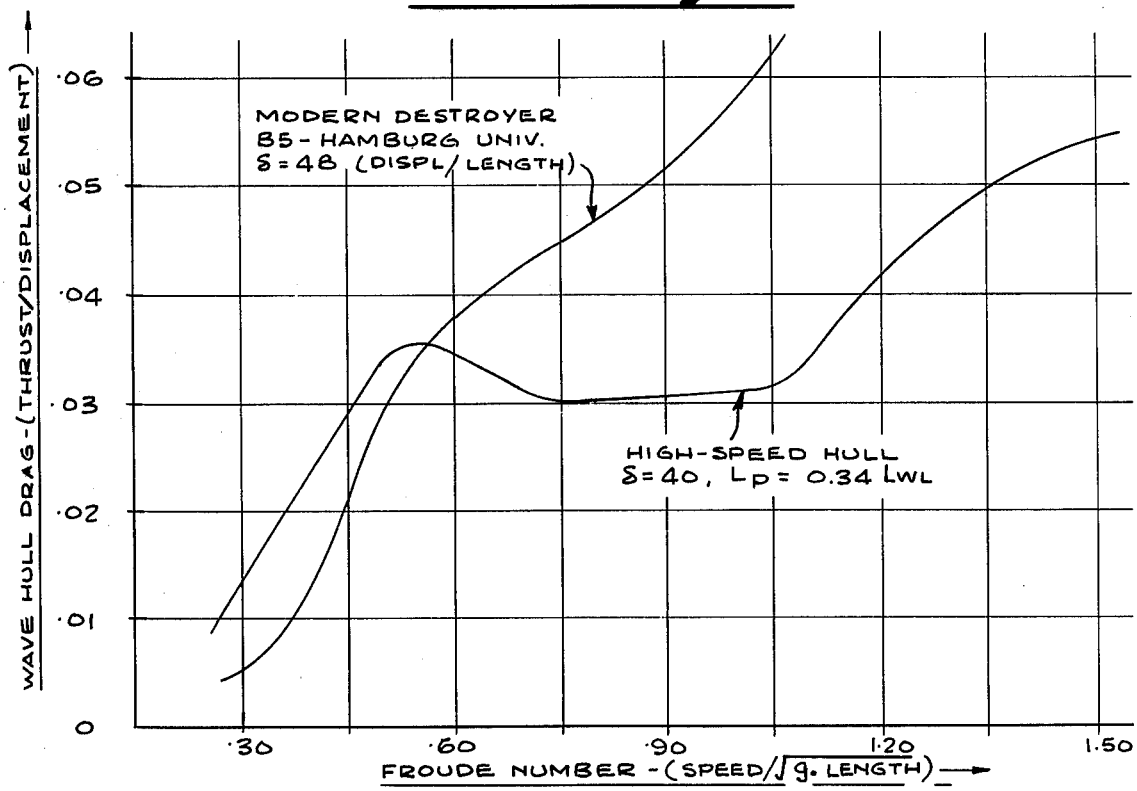

DISPLACEMENT HULL

BACKGROUND OF THE INVENTION

1. Field of the Invention

This invention relates to hulls for watercraft, and more particularly to a low-drag, high-speed displacement-type hull having a constant-section midbody extending over at least one-third of its waterline length.

2. Prior Art

The development of high-speed displacement-type watercraft hulls has been virtually stagnating for the past half-century, mainly because of the obstacles, heretofore believed insurmountable, presented by the rapid increase in the wave-generating drag attendant with increased speed. Improved analytical and model testing techniques have led to minor advances in the definition of the optimum hull, but the bulk of the effort devoted to the increase in the economically attainable limiting speed has been concentrated on planing hulls, hydrofoils and other hull forms which depend on dynamic lift generation, rather than displacement craft.

Problems of stability, construction cost, the need for operating in a displacement mode until sufficient forward velocity is achieved for the lift mechanism to become effective have generally limited the application of planing and hydrofoil hulls to relatively small vessels such as small naval craft, short-range ferryboats and pleasure craft, for which cost and operating economics are of secondary consideration.

Some improvements in the cruising speeds of commercial load-carrying vessels have been obtained by the steady increase in the size of their hulls, with the attendant reduction in the Froude Number for a given absolute velocity, and by the introduction of bulbous submerged forebodies designed to generate an out-of-phase wave train at certain specific speeds to interfere with the wave generation of the hull proper. Presently these techniques are applied to large ships operating at low Froude numbers and having hulls of otherwise conventional shape.

The primary object of this invention is to provide for the construction of displacement hulls having greatly reduced wavemaking resistance and surface friction.

Another object of the invention is to teach the design of such hulls which are simple in form and readily constructed with conventional techniques and materials.

A further object of the invention is to teach the design of a high-speed displacement hull in which a substantial portion of length comprises a parallel midbody of constant and full section.

Another object is to teach the design and construction of multi-hulled vessels with small hull spacing factors, employing hulls having the characteristics defined above.

Yet another object is to provide a class of displacement craft employing hull forms in the range of Froude numbers between 0.60 and 1.20, which require appreciably less propulsive effort than that required by equivalent conventional hull forms.

SUMMARY OF THE INVENTION

The foregoing objects and other objects and advantages which will become apparent from the following detailed description of several preferred embodiments of the invention, are attained in a hull employing a keel-less, constant-section midbody with a full section. To maximize the advantages offered by the novel design of the invention, the parallel midbody should be at least one-third the length of the hull and have a section coefficient not less than 0.785, in comparison with a half circle.

Preferably the midbody is adjoined by a very short run, not longer than one-sixth of the waterline length of the hull, formed with as full a section as possible, commensurate with providing the mountings and clearances for rudders, propellers and other components conventionally located at the stern of the hull.

The entry of the vessel is formed in a particularly unique manner. It is defined by a ramp sloping upwardly from the centerline of the hull bottom toward the waterline at the bow. The slope of this ramp is preferable between 1:16 and 1:12. The ramp extends over at least one-half the length of the entry section, modified by the requirement to fair the transition smoothly between the entry and the midbody and the definition of a prow at the bow end of the hull. Within the limitations imposed by the need for fairing curvature at either end of the ramp, the entry crosssection remains analogous to the sectional shape of the parallel midbody of the hull.

Significantly, no unusual limitations are imposed on the structural formation of the hull by the novel design and propostions propounded herein. The vessel may be constructed using conventional techniques and steel, aluminum, fibreglass or any other materials which are currently employed in the ship-building trades, or which may be developed in the future. Accordingly, in addition to the advantages of greater operating efficiency, as a result of the utilization of a substantial length of parallel midbody in place of the continually varying curvature of present hull forms, it is foreseen that the costs of constructing a hull in accordance with the invention will be considerably less than those of conventional displacement craft.

It will be noted that in vessels of the prior art parallel midbodies are commonly employed for the specific purpose of reducing the costs of construction and for providing loading spaces, holds or tanks of useful dimensions. Such ships are restricted, however, to relative speeds below Froude number 0.30.

The concept of relative speed is important in the understanding of hull performance. It is well known that wavemaking resistance is a direct function of the Froude number, defined as the absolute velocity divided by the square root of the product of length of the vessel and the constant of gravitational acceleration. Thus, in consequence, a long ship is able to travel faster for a given power-to-displacement ratio than a shorter one. The concept of the Froude number also permits the comparison of hull performance for ships having a wide range of sizes. The nondimensional speed represented by Froude's quotient can be used to plot their power requirements. As will be seen from the description which follows, despite the apparent similarity between conventional hulls having parallel midbodies and hulls constructed in accordance with the subject invention, for any given length and propulsive power, the latter are characterized by operating Froude numbers higher than 0.60 and, consequently, substantially higher absolute speeds.

THE DRAWINGS

The preferred embodiments of the invention will be described below with reference to the drawings, in which:

FIG. 4 is a diagramatic side elevation of the entry section of a hull according to the invention;

FIG. 5 is a sectional view of one-half of the entry of a typical high-speed displacement hull according to the invention, showing the contour lines thereof; and FIG. 6 is a graphical comparison of the performance of a prior art high-speed craft and a hull of similar fineness of the invention, showing a reduction in wavemaking drag by a factor of two at a Froude number of 1.05.

DESCRIPTION OF THE PREFERRED EMBODIMENTS

Figure 1:
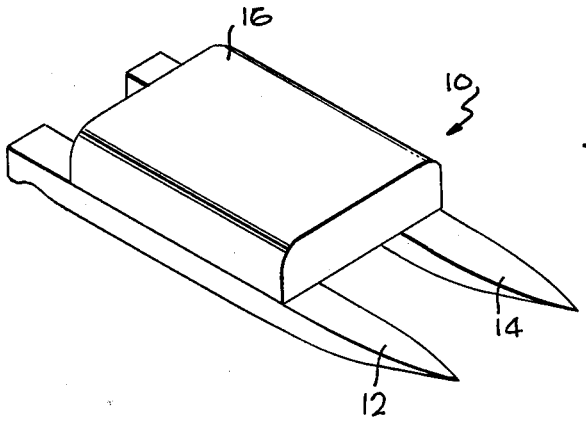
FIG. 1 is a perspective view of a twin-hulled vessel which is waterborne on a pair of displacement hulls constructed in accordance with the invention.

The perspective view of FIG. 1 shows a seagoing catamaran 10, supported by spaced, parallel hulls 12 and 14. A superstructure 16 bridges the midsections of the twin hulls and provides protected storage space for cargo and passengers.

The hulls 12 and 14 of the ship 10 are constructed to provide high speed capacity with relatively low propulsive effort. Their detailed structure will be discussed with reference to FIGS. 2A and 2B, but the nature of their wavemaking is such that a relatively narrow spacing may be provided between the hulls of the catamaran, without the punitively high interference drag factors encountered with hulled vessels of conventional hull construction.

Figure 2A:
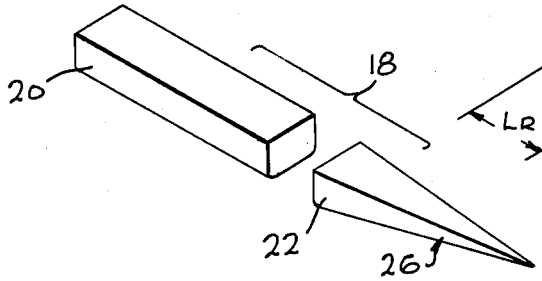
FIG. 2A is a schematic exploded representation of the principal hull elements incorporated in a vessel of the invention.

FIG. 2A is a perspective exploded view of a hull form illustrating the basic principles of the invention. A hull 18 is constructed from two major components, an elongated main body 20 of constant section, full in form and defined by convex sidewalls below the waterline, and an entry body 22 sharpening from a section corresponding to that of the main body to a point at the bow. The rate of contraction of the forebody is linear, so that all sections therethrough are similar, and in elevation the base of the entry forms a linear ramp 26. It should be noted that the discussion with respect to the hulls herein is restricted to those wetted portions lying below the mean water line and immersed in the buoyant medium.

Neither the forebody 22 nor the main body 20 is provided with a keel or other projections. It will be readily appreciated that the hull 18 does not constitute the form of a serviceable vessel. The shapes of the entry and of the main body do not provide for propulsive and steering component locations, and the carrying of the forebody shape to a fine point does not materially contribute to either hull displacement or a reduction in the total drag.

Figure 2B:
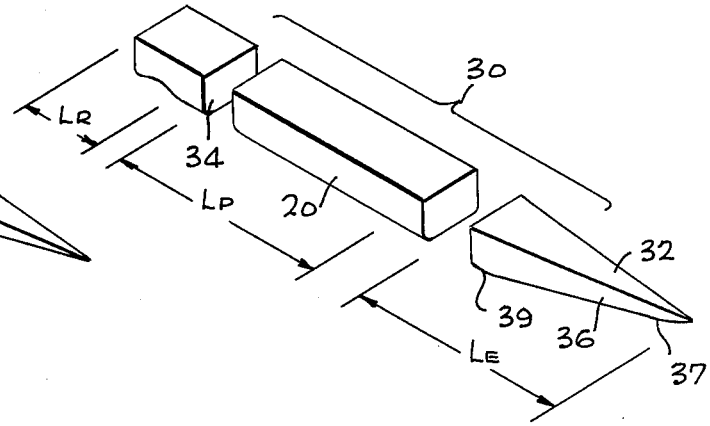
FIG. 2B is similar to the schematic representation of FIG. 2A, but incorporates the elements necessary to define a practical waterborne displacement hull.

FIG. 2B indicates the development of a hull 30, also in a perspective exploded view, in which the hull form illustrated in FIG. 2A is slightly modified to adapt it to practical seagoing vessels. The main hull portion 20 becomes a parallel, constant section midbody, adjoined by an entry 32 and a run 34. The run 34 is distinguished by a very short length, and is largely a modified portion of the midbody in which provisions have been made to accept a rudder and propellers. It has been found advantageous to reduce the length of the run, $L_R$, to no more than one-sixth of the total length of the hull; the lower the proportion, the more closely the resulting hull shape will approach the ideal represented in FIG. 2A.

The entry 32 is somewhat shorter than the ideal entry 22, although still extending over one-third of the hull length, or more. It is defined by a sloping basal ramp 36, a transition region 39 and an upwardly curving prow 37. The transition region 39 provides for a smooth fairing of the contours of the entry 32 into the outlines of the midbody 20.

The hull is defined completely by convex outer surfaces, unless the requirements of the propulsion and steering units command an appropriate modification in the run 34, where concave contours are permissible. It has been shown that the entry 32 of the hull 30 acts as a uniformly distributed source for wave generation, while the parallel midbody 20 serves as a sink for the waves so engendered. The net result of the arrangement of the hull 30 is a sharp reduction in the wavemaking resistance, especially at high Froude numbers.

Figure 3A:
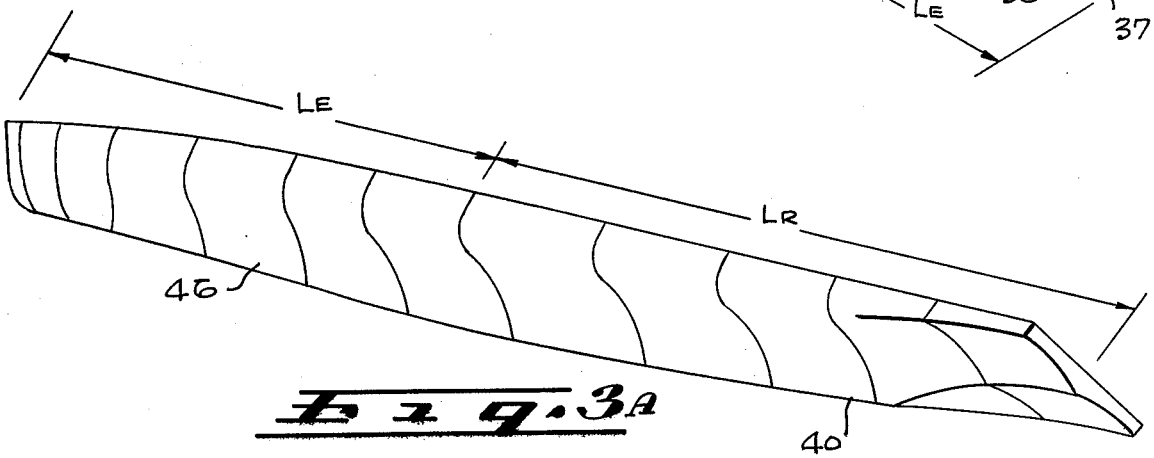
FIG. 3A is a perspective view of a conventional high-speed displacement hull, showing the surface thereof below the waterline.
Figure 3B:
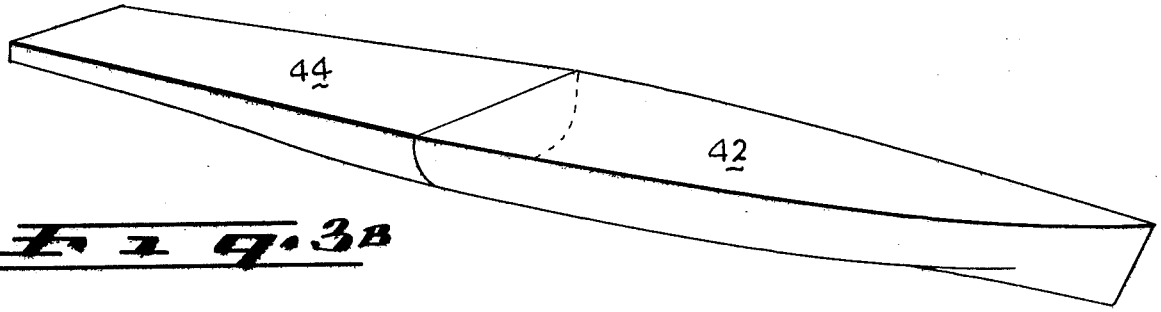
FIG. 3B is another view of the same hull, in a projection analogous to that of FIG. 2B.

A typical high-speed displacement hull 40 is shown in the perspective views of FIGS. 3A and 3B. The hull 40 is taken from a destroyer developed by the towing tank of Hamburg University and generally known as Model B-5. It consists of an entry 42 and a run 44, joined at the section of maximum beam slightly aft of the longitudinal center of the hull. The base of the hull is defined by a horizontal keel line extending from the bow to the buttocks, with portions of both the entry and the run showing concave curvatures in the region of the keel. The entire hull is characterized by continuously and smoothly varying curves. There is no parallel midbody, and a horizontal section along the waterline shows an outline continuously narrowing toward the bow and the stern. As with other conventional high speed hulls, the center of floatation is aft of the center of buoyancy.

FIG. 4 is a schematic center plane profile (not to scale) showing the contours of the entry 32 in detail. The base of the parallel midbody 20 defines a horizontal line which is designated, for want of a better term, the keel-line. The ramp 36 of the entry defines a line drawn between a point B along the keel line and slightly forward of the parallel midbody 20, and a point A which is along the waterline and forward of the prow. The line A-B defines the ramp angle, whose slope is chosen with a rise of one part in 10 to 18 parts and preferably one part in 12 to 16 parts along the horizontal. The entry length, $L_E$, is made up of three segments: an entry-to-midbody transition, the ramp length, $L_R$, and a bow flare. In order that the primary function of the entry ramp, the wave generating function, be preserved it is essential that $L_R$ be at least one-half of the entry length $L_E$. The prow or bow flare may extend up to 30% of the entry length, but preferably is about 20% of the entry length.

A frontal view of the entry 32, truncated at the line of symmetry of the hull, is shown in FIG. 5. Contour lines at stations corresponding to 10% increments of the entry length are also shown and labeled at the left of the figure. The proportions of the midbody section are carried forward through the transition region of the entry and for most of the ramp 36, the contour lines in the bow flare are, of necessity, divergent.

The sharply ramped entry of the hull 30 and the full form of the parallel midbody insure that the ratio of the prismatic coefficient of the complete hull to the prismatic coefficient of the entry, the factor $C_p/C_{pE}$, shows a substantial divergence from the value commonly encountered in vessels of the prior art. Commonly expected values of this factor are around unity, rarely rising above 1.1 or falling below 0.9, while the high speed hulls of the invention exhibit factors exceeding 1.2 and preferably between 1.35 and 1.65.

Similar differences arise in computation of other factors and ratios employed in the characterization of hull shapes by those skilled in the art. In particular the product of the previously defined ratio of prismatic coefficients and a similar factor relating the length of the hull along the waterline, $L_{WL}$, to the length of the run, $L_R$, ranges between 2.0 and 3.0 for conventional high speed hulls, while the corresponding values exceed 7.0, and may go higher than 15.0, for hulls designed according to the teachings herein. Unlike conventional prior art hulls the subject hull characteristically has its center of flotation forward of the center of buoyancy.

It can also be shown that not only is the wavemaking resistance lower in hulls with the characteristics shown in FIG. 2B, but the wetted surface on which purely frictional drag forces act is also lower for the novel hull form of the invention.

Wetted surface is defined mathematically by the formula $$WS = S\,(L \times \Delta)^{\frac{1}{2}}$$

where S is the coefficient of static wetted surface, L is the waterline length in feet, and Δ is the displacement in long tons of 2,240 pounds. When dealing in non-dimensional units naval architects substitute volume for displacement in the formula and employ consistent values for L and S.

In practice, the measured wetted surface coefficient, S, for high speed displacement hulls designed in accordance with the subject invention and having a typical base beam/draft ratio of 2.00 is less than 14.75 in British units, or 2.50 in non-dimensional units. The calculated top design limit for S is equal to, or less than $(14 + C_p^2)$. The significance of this limit will be appreciated when it is considered that for high speed displacement hulls of the prior art having a base B/H ratio 2.00, these coefficients generally fall in the range between 15.3 and 16.0.

A comparison between the performance of a model conforming to the destroyer hull 40 and that of another model of approximately the same fineness conforming to the subject invention is shown in FIG. 6. The wavemaking drag associated with each hull is plotted against a non-dimensional speed given by the Froude number. It is evident that a hull of the form represented by FIGS. 3A and 3B shows a drag increasing monotonically with speed. At the same time, a hull corresponding to that illustrated in FIG. 2B shows a characteristic increase in drag until a Froude number of 0.55 is reached and then a plateau of constant wave drag until the speed is further increased to a Froude number nearly twice as high. Although the resistance of the hull of the prior art is slightly lower for very low speeds, the curves cross at $N_F=0.55$, and at $N_F=1.05$ the novel hull form of the subject invention produces only one-half of the wave-making drag produced by the efficient prior art destroyer design.

As an example of the advantage to be derived by the present invention, a comparison may be made between two displacement vessels of 100 foot length and 45 ton displacement, and an installed propeller thrust of 300 pounds/ton displacement. This type and size of ship corresponds to naval escorts, fast ferries and the like, where the highest attainable speed is of great consequence. Referring to the graphs of FIG. 6, and using the appropriate WS coefficient for frictional drag, it can be calculated that the conventional hull design will reach a speed of about 25 knots at that thrust/weight ratio. In contrast, a ship designed with the lowdrag hull of the invention will reach a speed of about 35 knots. From the absolute speeds attained we know that the wave train generated by a hull of the subject invention is much longer than, and about one-third as destructive to harbor and riverine installations as that produced by a conventional vessel. It will be noted that in the practical operational speed range the power/weight ratio of the new craft fares even better when compared to planing-type vessels.

These substantial improvements are realized in a hull which is far more economical to construct than the continuously-curved hulls of the prior art, and which is especially well-suited for employment in multi-hulled vessels, e.g., catamarans or trimarans.

Since the construction of the earliest known catamaran ship of substantial size by Sir Walter Raleigh three centuries ago, multi-hulled vessels have been proposed as a solution to many of the problems facing the naval architect. The attraction lies in the broad deck, high roll resistance and, at first glance, low hull drag. In practice, however, the roll resistance is bought at very high structural cost imposed by the racking forces acting on the superstructure arising from the spacing of the hulls. This spacing must be very substantial, since drag becomes prohibitive with lesser hull spacing due to destructive interference of the wave trains generated by the hulls. The spacing between conventional displacement hulls operating at low-relative speeds, i.e., Froude numbers below 0.40, is generally about 20% of their waterline length. It averages about 30% one planing-type forms, No data are available on commercial applications of high-speed displacement form catamarans operating at Froude numbers higher than about 0.60, if indeed any such craft exist; however, high-speed sailing pleasure craft of that type use spacings of over 30% of the waterline length.

Because the subject design reduces the wave energy input to the surrounding sea, and since the balance of the energy is well distributed over a wave train generated along the entire entry section, rather than concentrated primarily in a single bow wave, the energy loss due to interference disappears almost completely. That is to say, the monotonic drag term, so called because interference induced drag increases substantially linearly with the reduction of the hull spacing factor, i.e., spacing of the centerlines/hull length, is greatly reduced in magnitude. As a result of this characteristic the spacing factor for catamarans constructed with hulls fashioned in accordance with the invention may be reduced to a value as low as 10% for low speed applications. For high speed applications up to Froude numbers of the magnitude of 1.50, the spacing factor can always be less than 25%, and preferably is between 10% and 20%. With the attendant reduction in the racking forces on the bridging structure, for the first time it is possible to achieve the many advantages which accrue from multi-hulled construction.

It will be seen from the foregoing that the invention teaches a high speed hull particularly adapted for operation in the Froude number range between 0.60 and 1.20. The hull comprises a constant section midbody preceded by a ramped entry and followed by a very short run. The midbody and the entry are always longer than one-third of the waterline length of the hull, and the run is always shorter than one-sixth of this length. The basal ramp of the entry extends for at least one-half of the entry length, defined as that portion of the hull forward of the constant-section midbody, and has a slope between 1:10 and 1:18. The ramp is preceded by an upswept bow and followed by a transition section fairing the entry contours smoothly into the midbody section. The entry and midbody are defined by convex curvatures in all wetted surfaces, and the midbody section coefficient is always greater than $\pi/4$. As far as practicable, the sectional shape of the midbody is carried forward into the entry, preferably as far as the bow section. Within the requirements inposed by the placement of the rudder, propellers or other directional control and propulsion devices, the run is essentially an extention of the midbody.

It will be understood that the particular examples and structures described herein have been chosen for illustrative purposes and are not intended to limit the scope of content of the invention as defined by the following claims.

I claim:

1. A fully bouyant bilaterally symetrical displacement hull for high-speed waterborne craft comprising an entry, a constant section midbody, and a run, said hull having a wetted portion which extends along the length of the hull wherein:

said constant section midbody extends over at least one third of the wetted length of the hull;

the wetted portion of said run extends over not more than one-sixth of the total wetted length of the hull; and the wetted portion of said entry has an upwardly and forwardly curving prow portion and a wetted length comprising the balance of the wetted length of the hull but not less than one-third of that length, with the basal surface of said entry defined by a linear ramp extending over not less than one-half of the wetted length of the entry.

2. The hull of claim 1, wherein said ramp is defined by a ramp angle of from 3° to 6°, and preferably between 3.5° and 4.25°.

3. The hull of claim 2, wherein said midbody has a transverse section coefficient of not less than 0.785, as defined by its wetted perimeter, and wherein the curvature of said perimeter is convex at all points.

4. The hull of claim 3, wherein said linear ramp is preceded at its foremost portion by an upswept prow extending over not more than about 30% of the wetted entry length, and preferably over about 20% of the wetted entry length.

5. The hull of claim 4, wherein the prismatic coefficient of the hull is at least 1.2 times the prismatic coefficient of the entry.

6. The hull of claim 5, wherein the prismatic coefficient thereof is between 1.35 and 1.65 times the prismatic coefficient of said entry.

7. The hull of claim 3, wherein transverse sections through at least the aft two-thirds of said entry are similar to the transverse section of said midbody.

8. The hull of claim 5, wherein the product of the prismatic coefficient of the hull multiplied by the wetted length of the hull and divided by the product of the prismatic coefficient of the wetted length of the entry and the wetted length of the run gives a non-dimensional coefficient greater than 7.0.

9. The hull of claim 8, wherein the value of said non-dimensional coefficient is greater than 10.0.

10. A high-speed waterborne marine craft including a pair of displacement hulls for operation at Froude numbers greater than 0.55, wherein:

each of said hulls is bilaterally symetrical and comprises an entry, a constant section midbody, and a run said hulls each having a wetted portion extending along the length of the hull;

the wetted portion of said constant section midbody extends over at least one-third of the wetted length of said hull;

the wetted portion of said run extends over not more than one-sixth of the total wetted length of said hull;

the wetted portion of said entry has an upwardly and forwardly curving prow portion and a wetted length comprising the balance of the wetted length of said hull but not less than one-third of that length, with the basal surface of said entry defined by a linear ramp extending over not less than one-half of the wetted length of the entry; and the hull spacing is less than 25% of the waterline length of said hulls.

11. The craft of claim 10, wherein said hull spacing is between 10% and 20% of the waterline length.

12. The craft of claim 10, wherein each of said hulls produces a wetted surface coefficient for a base beam/-draft ratio of smaller than 14.75 in British units, and smaller than 2.50 in non-dimensional units.

13. The craft of claim 10, wherein the longitudinal center of flotation is located forward of the longitudinal center of buoyancy.

* * * * *